US005718353A

United States Patent [19]

Kanfer et al.

[11] Patent Number: 5,718,353

[45] Date of Patent: Feb. 17, 1998

[54] TOWELETTE DISPENSING CLOSURE ASSEMBLY

[75] Inventors: Joseph S. Kanfer, Richfield; J. Christopher Wysocki, Stow; Detlev F. Smith, Akron, all of Ohio

[73] Assignee: GOJO Industries, Inc., Cuyahoga Falls, Ohio

[21] Appl. No.: 646,491

[22] Filed: May 8, 1996

[51] Int. Cl.[6] ..... B65H 1/00

[52] U.S. Cl. ..... 221/63; 221/61; 215/331; 220/254; 220/259; 220/297; 206/812

[58] Field of Search ..... 215/329, 330, 215/331; 220/254, 255, 259, 297, 298, 301; 206/390, 205, 210, 409, 812; 221/61, 63

[56] References Cited

U.S. PATENT DOCUMENTS

| | | | |
|---|---|---|---|
| 3,572,305 | 3/1971 | Moragne | 220/301 |
| 3,738,536 | 6/1973 | Gach | 220/298 |
| 4,017,002 | 4/1977 | Doyle et al. | 221/63 |
| 4,219,129 | 8/1980 | Sedgwick | 221/63 |
| 4,534,491 | 8/1985 | Norton et al. | 221/63 |
| 4,905,868 | 3/1990 | Beane et al. | 221/63 |
| 5,467,893 | 11/1995 | Landis, II et al. | 221/34 |
| 5,560,514 | 10/1996 | Frazier | 221/63 |

FOREIGN PATENT DOCUMENTS

| | | | |
|---|---|---|---|
| 0455172 | 11/1991 | European Pat. Off. | 220/254 |

*Primary Examiner*—H. Grant Skaggs
*Attorney, Agent, or Firm*—Reese Taylor

[57] ABSTRACT

A closure assembly for attachment to the lid of a container for the storage and dispensing of towelettes or similar articles is constructed so as to be receivable within a preformed keyhole-shaped opening in the container lid. The assembly includes a body with a main radially extending flange larger than the opening in the lid. The lower portion of the body carries radially extending locking tabs which are dimensioned to fit through the lid opening and, upon the closure being turned, to engage the lower surface of the lid in opposed relationship with the flange which engages the upper surface. Antirotation tabs also extend radially of the lower portion of the body and again, upon rotation, engages the edges of the lid opening to thus secure the closure on the lid. A cap is also provided to releasably engage the upper portion of the closure body to provide a substantially airtight seal for the container.

11 Claims, 3 Drawing Sheets

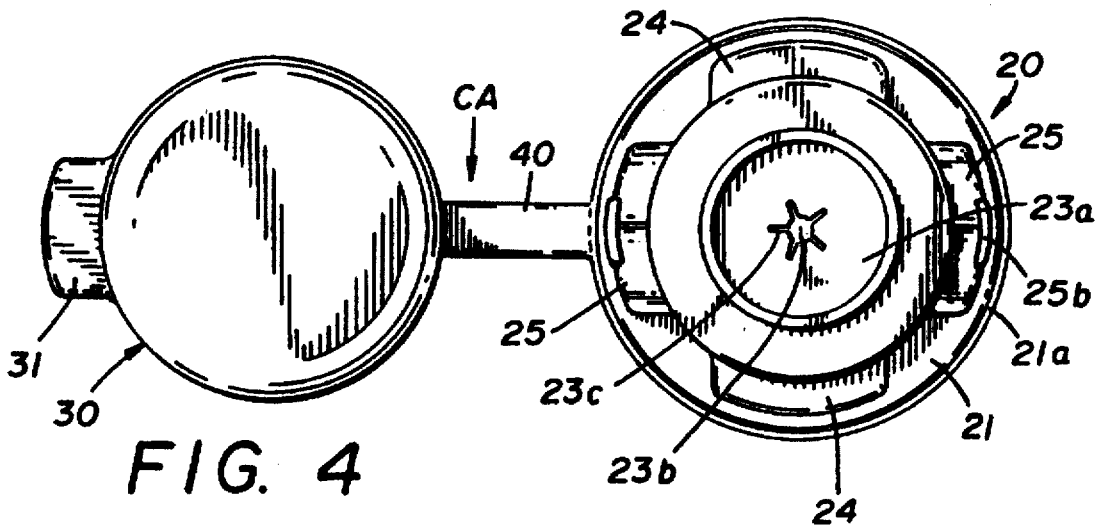
FIG. 4
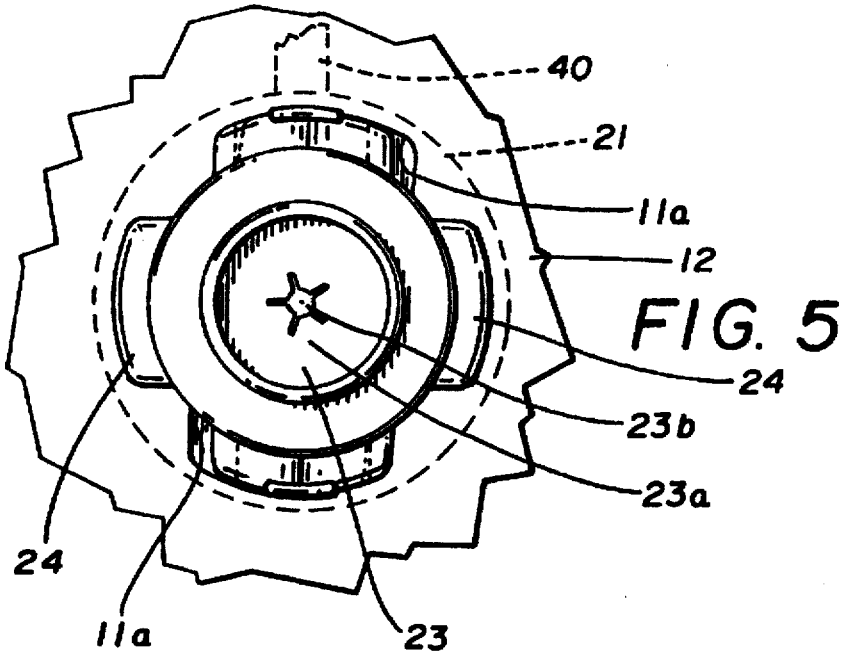
FIG. 5
FIG. 6
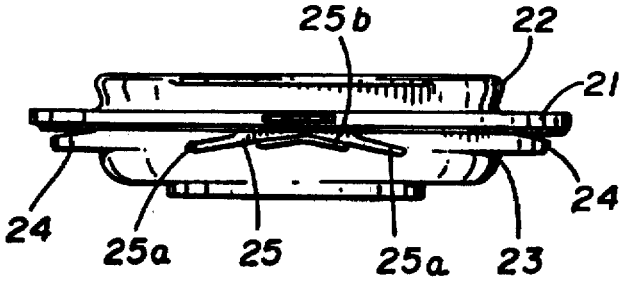

TOWELETTE DISPENSING CLOSURE ASSEMBLY

RELATED PATENT APPLICATIONS

None.

FIELD OF THE INVENTION

This invention relates to closures for containers and relates in particular to a removable closure assembly intended to be received on the lid of a container containing tissues or similar materials which are dispensed through a central aperture in the lid.

BACKGROUND OF THE INVENTION

It is known in the art to provide moisturized towels or tissues for the convenience of various users. Such items, often referred to as towelettes, can be found in many places, such as commercial aircraft, restaurants, medical facilities, etc., and are impregnated with various cleaning and/or sterilizing materials. Similar products are also marketed in the infant care field. These towelettes are packaged in a number of different ways ranging from individual packages containing one towelette to upright cylindrical containers in which a roll of towelettes is provided and wherein the towelettes are pulled through the top of the container and then tom off to be used individually.

In the prior art, it is known to provide such a cylindrical container, which normally has a removable top lid, with the towelettes or other materials being disposed within the body of the container in a roll. These tissues or towelettes are perforated at appropriate intervals and intended to be drawn through the lid of the container and tom off for individual use.

In the prior art, generally the container lid is removable so that the roll of towelettes may be inserted and then is reaffixed to the top of the container body in substantially airtight condition so as to maintain the moisture of the towelettes.

In such an arrangement, various types of slits or other openings are provided in the lid so that the towelette may be pulled through and tom off for use. An example can be seen in Doyle U.S. Pat. No. 4,017,002.

The prior art also discloses closures which can be inserted into a preformed aperture in the center of the lid. The lids may be removably attached to the containers or otherwise affixed thereto. The closures are normally provided with an aperture or slot in their centers through which the towels may be removed. They normally are connected to the lid by opposed locking tabs and, in that regard, the central aperture in the lid itself generally has opposed slots which can receive these tabs. The closures are simply flexed and the tabs snapped into place to hold the closure in place against inadvertent removal during removal of the towelettes. In this form of the prior art, a cap is normally provided to close off the top of the closure so as to attempt to maintain the airtight condition of the interior of the container and prevent the towelettes from drying out.

While the prior art just described is presumably adequate for the purposes for which it has been designed, there are several problems which Applicant has noted.

First, the towelettes are stored in the container in the form of a roll with each individual towelette separated from the next by perforations. As the leading towelette is pulled out through the lid and closure, the towelettes are intended to unwind from the roll. However, in practice, this does not always happen as ideally designed and there is the possibility that the strip of towelettes will become twisted. At that point, when a towelette is pulled through the closure opening, it is possible that the added tension required will cause either premature separation of the towelettes or dislodgement of the closure and, inasmuch as the towelette is being pulled upwardly at this time, the closure can often be pulled away from the lid.

A further difficulty with the prior art observed by Applicant is that the manner of locking the closure to the lid requires fairly close manufacturing tolerances. In some of the prior art, the closures are circular in plan and are dropped into the lid opening and rotated. Specifically, this is generally accomplished by providing diametrically opposed radially extending locking tabs or flanges which are dropped into the slots in the container lid and then rotated so as to underlie the lid. In that fashion, of course, a direct vertical or axial pull on the closure will not dislodge it because the planar faces of the tabs or flanges will engage the inner surface of the lid. The difficulty is, however, that unless the space between the flange of the closure and the locking tabs is held to a close tolerance approximating the thickness of the lid, this is a very loose and insecure fit. It is very difficult to hold tolerances to these exacting demands in practice. However, as noted above, when the towelettes become twisted, the extraction movement may rotate the closure to the unlocked condition.

It is, therefore, believed desirable to provide a closure member of the type described herein which can be securely locked in place and against inadvertent rotation and removal and which can also accommodate varying thicknesses of lids.

SUMMARY OF THE INVENTION

It accordingly becomes a principal object of this invention to provide a closure assembly which can be positioned on the lid of a container of the type above described and locked in place against inadvertent removal. It is a further principal object of the invention to provide such a closure member which will accommodate varying thicknesses of lids while insuring a snug fit between the closure and the lid so as to be usable with virtually any commercially available container lid.

It has been found that these objects can be achieved by providing a closure having a main flange portion larger than the basic diameter opening of the lid and a connecting portion which depends from the flange portion and has diametrically opposed locking and locating tabs which extend radially outwardly from the walls of the connecting portion for engagement with the lower surface of the lid and with the edge surface thereof.

It has been found that the principal objects of the invention can be further achieved by providing a first pair of diametrically opposed flat tabs which fit beneath the bottom surface of the lid and a second pair of diametrically opposed angled tabs which will engage the edge surface of the aperture in the lid and the bottom surface of the lid, thereby assuring that the closure will be firmly secured in the lid against inadvertent removal by rotation of the closure.

Accordingly, production of an improved closure assembly of the type above described becomes the principal object of this invention, with other objects thereof becoming more apparent upon a reading of the following brief specification considered and interpreted in view of the accompanying drawings.

BRIEF DESCRIPTION OF THE DRAWINGS

FIG. 4 is a bottom plan view of the improved closure assembly in its "as molded" condition;

FIG. 5 is a partial bottom plan view showing the closure assembly in its assembled position on the container;

FIG. 6 is a side elevational view of the closure assembly;

BRIEF DESCRIPTION OF THE PREFERRED EMBODIMENTS

Figure 1:
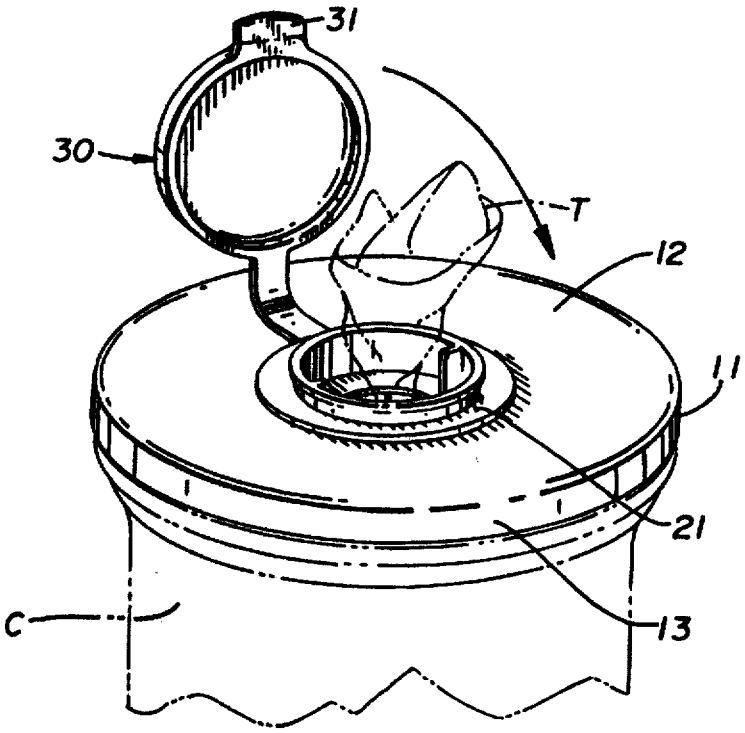
FIG. 1 is a perspective view showing the improved closure assembly and lid in place on the top of a container.

Referring first to FIG. 1, it will be seen that the container, generally indicated by the letter C and only partially illustrated, is a cylindrical member with a hollow interior which is intended to receive a roll of towelettes T. The invention is illustrated in FIG. 1 in its open, ready-to-use condition. It should be noted here that, while a cylindrical container is illustrated, the container could well have other configurations.

Still referring to FIG. 1, it will be seen that a lid 11 is received on the top of the container. This lid has a top wall 12 and a circumferential skirt 13 and can be attached to the container C either by providing threads in the skirt or sidewall 13 thereof to mate with threads on the outer surface of the container, or by being press-fit thereon or even hingedly attached. Any conventional way of affixing the lid 11 to the container C to maintain a substantially airtight seal, when closed, will be contemplated in this invention.

Still referring to FIGS. 1, 5, 7 and 8 of the drawings, it will be seen that the lid 11 has a through central aperture 14 in top wall 12 thereof, and that aperture has two radially extending and substantially diametrically opposed slots 11*a*, 11*a* for initial insertion of the closure member as will be described. The through central aperture 14 may be formed in lid 11 during the molding process or subsequently cut therein.

Figure 2:
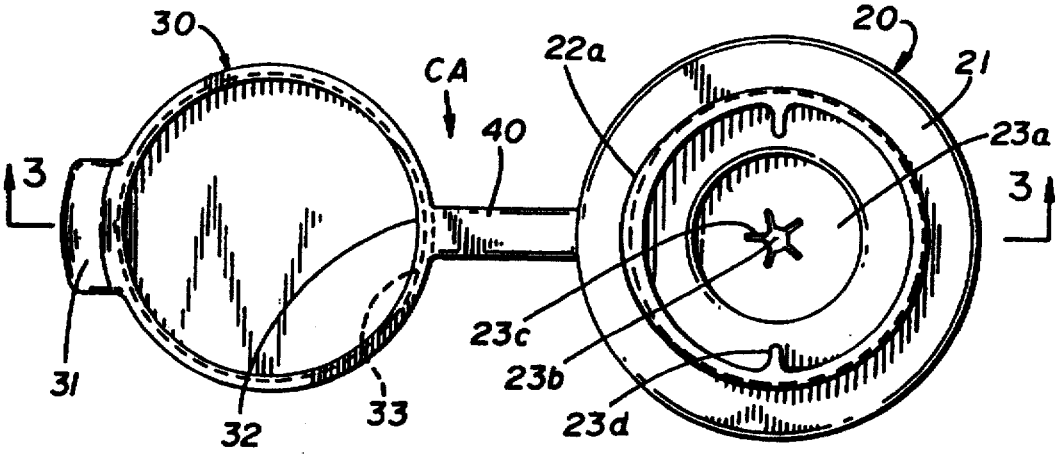
FIG. 2 is a top plan view of the improved closure assembly in its "as molded" condition.
Figure 3:
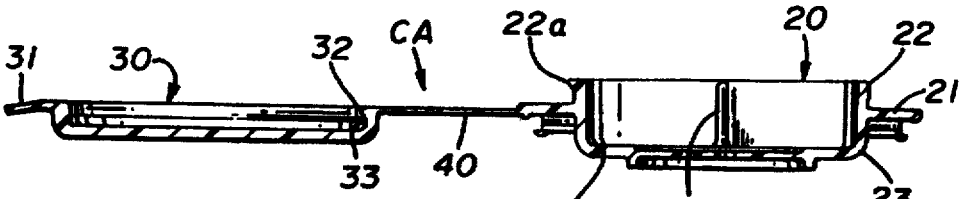
FIG. 3 is a sectional elevational view taken along the line 3—3 of FIG. 2.

Referring next then to FIGS. 2 and 3 of the drawings, it will be seen that the closure assembly, generally indicated by the letters CA, includes a closure 20, a cap 30 and a connecting strap 40 which interconnects the closure and the cap.

Figure 7:
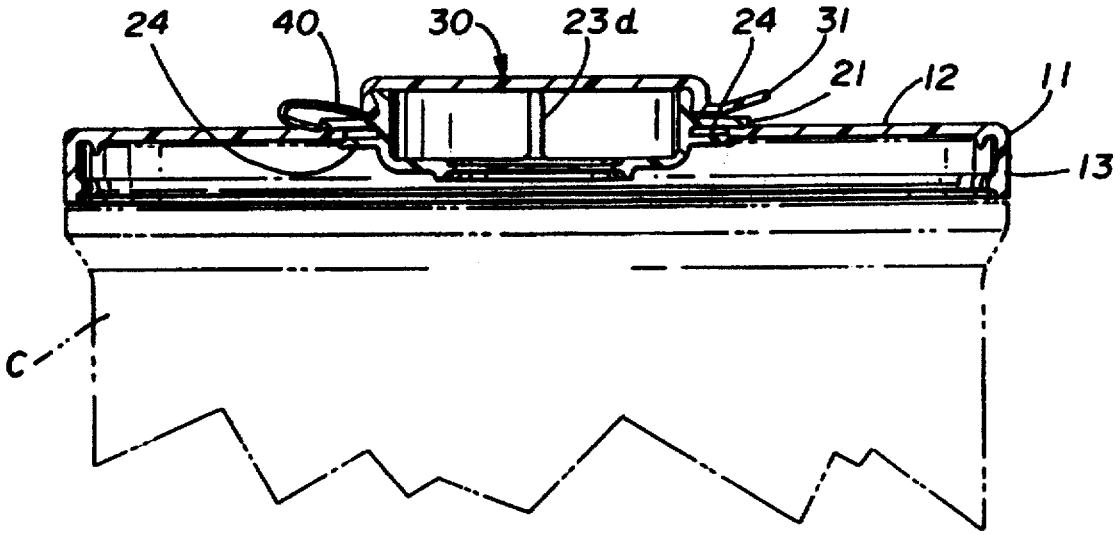
FIG. 7 is a side elevational view partially in section showing the closure assembly in place on the container in its first locked position.
Figure 8:
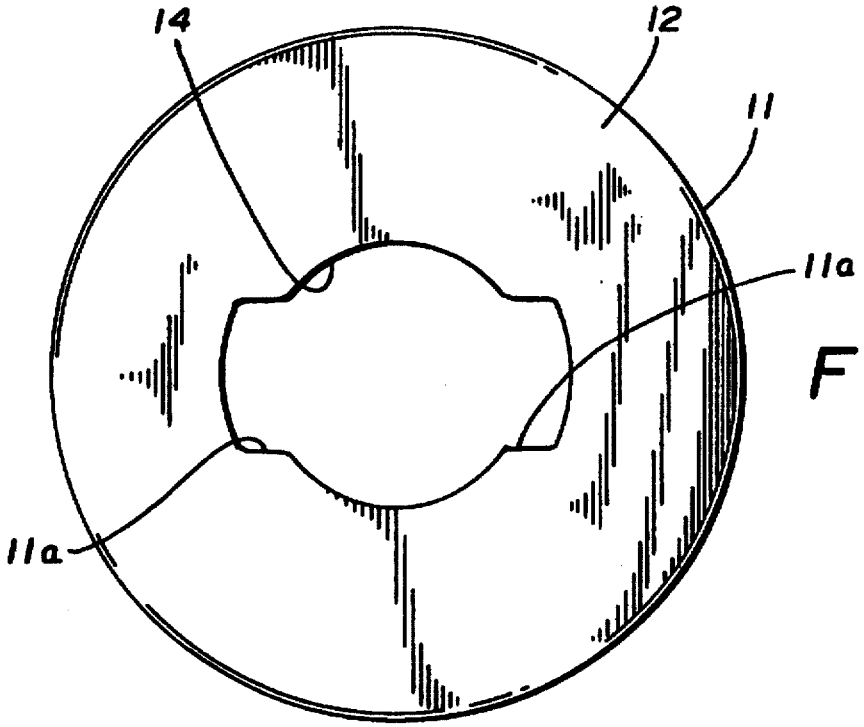
FIG. 8 is a top plan view of a typical lid with slots for the closure member provided.

The closure 20 has a flange portion 21, the diameter of which is greater than the diameter of the opening in the top wall 12 of the lid 11 so that, when assembled, it will rest on the top or outer surface of top wall 12 of the lid 11 as shown in FIGS. 1 and 7.

The body portion of closure 20 is essentially cup shaped and includes upper and lower body sections 22 and 23. The lower body section 23 is cup shaped and has a bottom wall 23*a* with a through central aperture 23*b* from which slots 23*c* extend radially. It is intended that the towelette T will be threaded through the aperture 23*b* and pulled from the container C through that aperture. The particular aperture design, e.g., the radiating slot arrangement, is only one of many which may be selected, depending on such factors as the towelette material and the thickness of the towelette material and the perforation sensitivity. Finally, ribs or drive dogs 23*d* project upwardly from bottom wall 23*a* and can be used to assemble the closure 20, as will be subsequently described.

Still referring to FIGS. 2, 3 and 4 of the drawings for a further description of closure 20, it will be seen that the upper body section 22 extends above the flange 21 and is essentially an extension of the substantially cylindrical wall of lower body section 23. This upper body section 22 serves as a seat for the cap 30 and provides for the snap connection therebetween, as can be seen in FIG. 7. The cap 30 also has a finger engaging lip 31 so that it can be closed, as shown in FIG. 7 of the drawings, and is securely and permanently attached to the closure 20 by strap 40. Of course, the cap can be opened by simply engaging lip 31 and snapping cap 30 off the top of upper body section 22. Also, when the container is not in use, the cap 30 can be moved to the closed position in FIG. 7, thereby maintaining the substantially airtight seal in the container C and maintaining the moisture content of the towelettes. It should be noted, from FIG. 6, that the wall 22*a* of upper body section 22 tapers downwardly and inwardly to facilitate the secure engagement of skirt or wall 32 of cap 30 therewith.

Depending on the material used to fabricate the closure assembly CA, when the cap 30 is in the position of FIG. 7, there may be a tendency for strap 40 to lift the edge of the cap closest to the strap off the closure 20. Therefore, cap 30 has an undercut portion 33 extending around a portion of the inner wall of cap 30 and this is intended to engage a complemental bead 22*a* on the outer wall of upper body section 22 (see FIG. 2) to insure that cap 30 stays in place. Finally, lip 31, which is angled upwardly (see FIG. 7), is preferably dimensioned so that, when the cap is in position on closure 20, it projects beyond the wall of the closure member and skin 21, as shown in FIG. 7, for easy access by the user when it is desired to disengage the cap.

Referring next then to FIGS. 4, 5 and 6 of the drawings for a further description of the lower body section 23 of the closure 20, it will be seen that it includes diametrically opposed locking tabs 24,24. These tabs extend outwardly from the cylindrical wall of section 23 and, as can be seen in FIG. 6 of the drawings, are ramped or tapered downwardly so as to be spaced from and lying in a plane below the plane of the flange portion 21. It is contemplated that, in assembly, these would be registered with and fit through the two substantially diametrically opposed slots 11*a*, 11*a* in the lid 11. Rotation of the same about the central axis of the closure 20 will bring these tabs into underlying relationship with the bottom surface of the top wall 12 of the lid 11, as can be seen in FIG. 7 of the drawings, and thereby prevent inadvertent removal or disengagement of the closure member 20 by movement in a vertical direction during removal of the towelettes from the container.

However, as previously noted, one of the difficulties with these types of dispensers is that the roll of towelettes tend to get twisted during use or users pull them out from different angles and, in pulling them out through the aperture 23*b*, the entire closure 20 often tends to rotate. In the conventional construction, the possibility exists that this would bring the tabs 24,24 back into alignment with the slots 11*a*, 11*a* in the lid 11 and permit the entire closure 20 to be pulled out.

Accordingly, as can be seen in FIGS. 4 through 6 of the drawings, a second set of antirotation locking tabs 25,25 are provided. These tabs are arranged in substantially diametrically opposed condition and, alternately, 90° from the locking tabs 24,24. These tabs 25,25 include opposed, angularly disposed wall surfaces 25*a*, 25*a* which taper from the radially outermost edges of the tabs 25,25 upwardly toward the flange 21 and finger engaging projections 25*b*,25*b*.

Rotation of the closure, once it has been inserted in the lid, will bring the wall surfaces 25*a*,25*a* into engagement with the edges of the slots 11*a*, 11*a* in the lid 11 to securely lock the closure in place with sufficient security to prevent inadvertent removal by rotation.

The spacing between the locking tabs 24,24 and the flange 21 is substantially the same as the thickness of the top wall 12 of the lid 11 so that a secure lock and seal may be achieved, but the fit is often not sufficiently tight so as to resist any turning movement imparted by extraction of the towelettes T to the closure 20. However, the provision of the antirotation tabs 25,25, and particularly the angularly disposed surfaces 25*a*,25*a*, insures that regardless of the degree of the fit just described, such turning movement will be strongly resisted and will prevent inadvertent removal of the closure member 20. In this fashion, a significant range of manufacturing differences, intentional or unintentional, in the thickness of top wall 12 of lid 11 can be accommodated.

In use of the improved closure, it is simply necessary to align locking tabs 24,24 with the slots 11*a*, 11*a* in the lid and drop them through the slots, followed by turning the closure with the help of ribs or dogs 23*d* to engage the locking tabs 24,24 and antirotation tabs 25,25 with the top wall 12 of lid 11. The locking tabs will engage the lower surface of top wall 12 and trap it between themselves and flange 21 to prevent axial or vertical disengagement. Further rotation permits antirotation tabs 25,25 to drop through to slots in the lid and engage the edges of the lid aperture to prevent inadvertent rotational disengagement. Insertion of antirotation tabs 25,25 may be assisted by projections 25*b*,25*b*.

While a full and complete description of the invention has been set forth in accordance with the dictates of the patent statutes, it should be understood that modifications can be resorted to without departing from the spirit hereof or the scope of the appended claims.

Thus, it will be noted that "towelettes" have been referred to herein for simplicity of description. However, it will be apparent that other articles could be dispensed using the closure of this invention.

Further, while a snug, substantially airtight fit may be obtained by the mechanical structure just described, and while that structure is adequate to provide the required resistance to inadvertent removal, the sealing properties can be further enhanced by permanently securing the closure to the lid by various means, such as by sonic welding, adhesives, heat sealing or other expedients. To that end, a circumferential bead 21*a* is provided which can provide a high point for an ultrasonic seal.

Also, while the closure assembly has been illustrated and described as including connecting strap 40 between cap 30 and closure 20, it could, if desired, be a separate member.

What is claimed is:

1. A closure assembly for a container for moistened articles, said container having a hollow body for storing the articles, an open top and an apertured lid for closing off the open top, the aperture having radially extending and diametrically opposed through slots, the closure comprising:

a) a removable closure member;

b) said removable closure member including 1) a body portion and 2) a cap;

c) said body portion including 1) an upper body section, 2) a lower body section, and 3) a flange disposed between said upper and lower body sections and having a diameter greater than that of said body sections and of the aperture on the lid;

d) said lower body section including 1) a pair of diametrically opposed locking tabs projecting radially outwardly therefrom and 2) a pair of diametrically opposed antirotation tabs projecting radially outwardly therefrom and being circumferentially offset from said locking tabs; and e) said cap being releasably received on said upper body section.

2. The closure assembly of claim 1 wherein a connecting strap interconnects said closure member and said cap.

3. The closure assembly of claim 2 wherein said cap has an annular wall; said annular wall being undercut for a portion of its length adjacent said connecting strap.

4. The closure assembly of claim 3 wherein said upper body portion has an annular wall; and a radially extending rib is disposed on said wall for a portion of its length adjacent said connecting strap.

5. The closure assembly of claim 1 wherein said lower body section is cup-shaped and has a bottom wall and a cylindrical side wall; said bottom wall having a substantially centrally disposed through aperture therein.

6. The closure assembly of claim 5 wherein said through opening in said bottom panel includes an open central area and at least one radially extending slot extending outwardly therefrom toward said cylindrical wall portion.

7. The closure assembly of claim 1 wherein said upper body section has a generally cylindrical sidewall extending upwardly toward its top edge from said flange.

8. The closure assembly of claim 1 wherein said cap includes a finger engaging lip extending radially outwardly therefrom.

9. The closure assembly of claim 1 wherein said locking tabs comprise a pair of diametrically opposed, substantially flat tabs juxtaposed beneath and spaced from said flange; and said antirotation tabs comprise a pair of diametrically opposed angled tabs having converging walls tapering upwardly toward said flange from their radially extending edges.

10. The closure assembly of claim 9 wherein said flat tabs and said angled tabs are alternately disposed at substantially 90° from each other.

11. The closure assembly of claim 9 wherein said antirotation tabs include engagement projections on their surfaces adjacent said main flange.

* * * * *